US007331064B1

(12) United States Patent
Quintal

(10) Patent No.: US 7,331,064 B1
(45) Date of Patent: Feb. 19, 2008

(54) VENTILATED CAP APPARATUS

(76) Inventor: Donie N. Quintal, 15709 Seaforth Ave., Norwalk, CA (US) 90650

( * ) Notice: Subject to any disclaimer, the term of this patent is extended or adjusted under 35 U.S.C. 154(b) by 0 days.

(21) Appl. No.: 11/625,303

(22) Filed: Jan. 20, 2007

(51) Int. Cl.
*A42B 1/24* (2006.01)

(52) U.S. Cl. ..... 2/209.13; 2/171.3

(58) Field of Classification Search ..... 2/209.13, 2/171.3
See application file for complete search history.

(56) References Cited

U.S. PATENT DOCUMENTS 3,735,423 A * 5/1973 Droz ..... 2/171.3
4,141,083 A * 2/1979 Waters ..... 2/171.3
4,546,496 A 10/1985 Lewis
4,858,627 A 8/1989 Netschert
4,893,356 A * 1/1990 Waters ..... 2/171.3
6,760,925 B1 * 7/2004 Maxwell ..... 2/171.3
7,143,451 B2 * 12/2006 Lundgren ..... 2/171.3

* cited by examiner

*Primary Examiner*—Katherine Moran
(74) *Attorney, Agent, or Firm*—Crossley Patent Law; Mark A. Crossley

(57) ABSTRACT

The ventilated cap apparatus provides for highly efficient cage fan ventilation from a housing fitted to the cap crown front and bill. The vertically oriented cage fan provides a slim profile housing with a vertical housing front, for advertising, team logos, and the like. Air is drawn through the housing and channeled through the brim to two spaced apart exhaust ports on the underside of the brim, thereby ventilating the user's face. Varied embodiments of the apparatus are provided for fit to varied shapes of the cap crowns. A solar cell is provided in top of the housing in one embodiment. Directionally adjustable louvers are provided for air intake in an embodiment of the apparatus.

19 Claims, 2 Drawing Sheets

VENTILATED CAP APPARATUS

SPECIFICATION

To All Whom It May Concern

Be it known that I, Donie N. Quintal, a citizen of the United States, have invented new and useful improvements in a ventilated cap apparatus as described in this specification.

BACKGROUND OF THE INVENTION

Smoke free environments are not always possible, whether smoke from cigarettes or other air contaminants invade the air. Personal ventilation devices can provide an improved personal and localized environment in areas invaded by smoke, and offer facial cooling as well. What is needed is a personal ventilation apparatus which is adaptable to existing cap designs. The apparatus should provide sufficient air flow to the face of a user such that smoke and other air contaminants are blown away from the user's breath intake. Desirable design parameters dictate a basic and adaptable apparatus, and an apparatus which provides the best ventilation possible with the least amount of energy expended. Solar power is also a desirable feature. Further, a lightweight design is desirable. An additional need is air filtration. The present apparatus fulfills such design parameters.

1. Field of the Invention

The ventilated cap apparatus relates to personal ventilation devices and more especially to a ventilated cap apparatus that is adaptable to existing lightweight cap designs.

2. Description of the Prior Art

Prior related art U.S. Pat. No. 4,858,627 issued to Netschert on 1989-08-22 teaches a complex air filtration and purification hat. The hat has objectives far overreaching those of the present apparatus, and is therefore far more expensive to produce and sell. U.S. Pat. No. 4,546,496 issued to Lewis on 1985-10-15 teaches a device for fitting to the bill only of a hat. The bill only fit dictates that the device be used only with hats of sufficiently heavy construction to support such a device on the bill. Most lightweight caps cannot support such a device. Further, the device uses a blade fan, which cannot flow air as efficiently or as forcefully as the present cage fan apparatus, without the addition of far more power than the present apparatus, and therefore additional weight. U.S. Pat. No. 3,735,423 issued to Droz on 1973-05-29 teaches an entire hat structure. The device does not incorporate solar power. The device is not adaptable to present lightweight cap designs.

While the above-described devices fulfill their respective and particular objects and requirements, they do not describe a ventilated cap apparatus that provides for the advantages of the present ventilated cap apparatus. In this respect, the present ventilated cap apparatus substantially departs from the conventional concepts and designs of the prior art. Therefore, a need exists for an improved ventilated cap apparatus.

SUMMARY OF THE INVENTION

The general purpose of the ventilated cap apparatus, described subsequently in greater detail, is to provide a ventilated cap apparatus which has many novel features that result in an improved ventilated cap apparatus which is not anticipated, rendered obvious, suggested, or even implied by prior art, either alone or in combination thereof.

To attain this, the ventilated cap apparatus enables fit to many present lightweight caps designs, with minimal design intrusion due to the basic nature of the apparatus. The apparatus is energy efficient, due to both solar cell inclusion and to the cage fan. Cage fans are accepted as providing significantly more airflow capability when compared to, for example, blade fans. The small fan efficiency, solar cell, and small battery combine to provide a lightweight apparatus. Additionally, the replaceable filter offers filtered air in front of a user's face. Further, the apparatus is supported by both the bill and front crown of a cap, thereby providing adequate support even on a lightweight cap. Lightweight caps are often porous, thereby providing for efficient individual cooling of a person wearing both the cap and the fitted apparatus. Additionally, the apparatus provides for directed airflow via the optional louvers, for greatest efficiency in clearing breathable air for the user. The cage fan is substantially vertically oriented, thereby conforming to a small allotted space within the housing. The vertical orientation of the cage fan provides for air intake proximal to the top of the housing, with discharge out of the bill through transfer channels. The transfer channels conduct air to the exhaust ports which are disposed on the underside of the bill. The exhaust ports are spaced apart toward the outer side perimeters of the bill for best clearance of air in front of a user's face.

All components of the fan, fan ducting, louvers, replaceable filter, motor, battery, and solar cell are chosen to provide for lightweight and for compact size, while delivering the maximum amount of air possible in such a compact design. The design further allows for only minor changes in the housing for fit to either a curved front crown or straight front crown cap.

Thus has been broadly outlined the more important features of the improved ventilated cap apparatus so that the detailed description thereof that follows may be better understood and in order that the present contribution to the art may be better appreciated.

An object of the ventilated cap apparatus is to inexpensively ventilate a user's face and head.

Another object of the ventilated cap apparatus is to be visually unobtrusive.

A further object of the ventilated cap apparatus is to be energy efficient.

An added object of the ventilated cap apparatus is to provide outstanding size and weight/air flow ratio.

And, an object of the ventilated cap apparatus is to provide for advertising, team logos, and the like on the housing front.

Further, an object of the solar cell equipped embodiment of the ventilated cap apparatus is to be energy self-sufficient.

Additionally, an object of the ventilated cap apparatus is to be light weight.

Another object of the ventilated cap apparatus is to provide directional air flow adjustment.

Still another object of the ventilated cap apparatus is to provide filtered air to the user.

These together with additional objects, features and advantages of the improved ventilated cap apparatus will be readily apparent to those of ordinary skill in the art upon reading the following detailed description of presently preferred, but nonetheless illustrative, embodiments of the improved ventilated cap apparatus when taken in conjunction with the accompanying drawings.

In this respect, before explaining the current embodiments of the improved ventilated cap apparatus in detail, it is to be understood that the ventilated cap apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved ventilated cap apparatus. It is therefore important that the claims be regarded as including such equivalent constructions insofar as they do not depart from the spirit and scope of the ventilated cap apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 4 thereof, the principles and concepts of the ventilated cap apparatus generally designated by the reference number 10 will be described.

Figure 2:
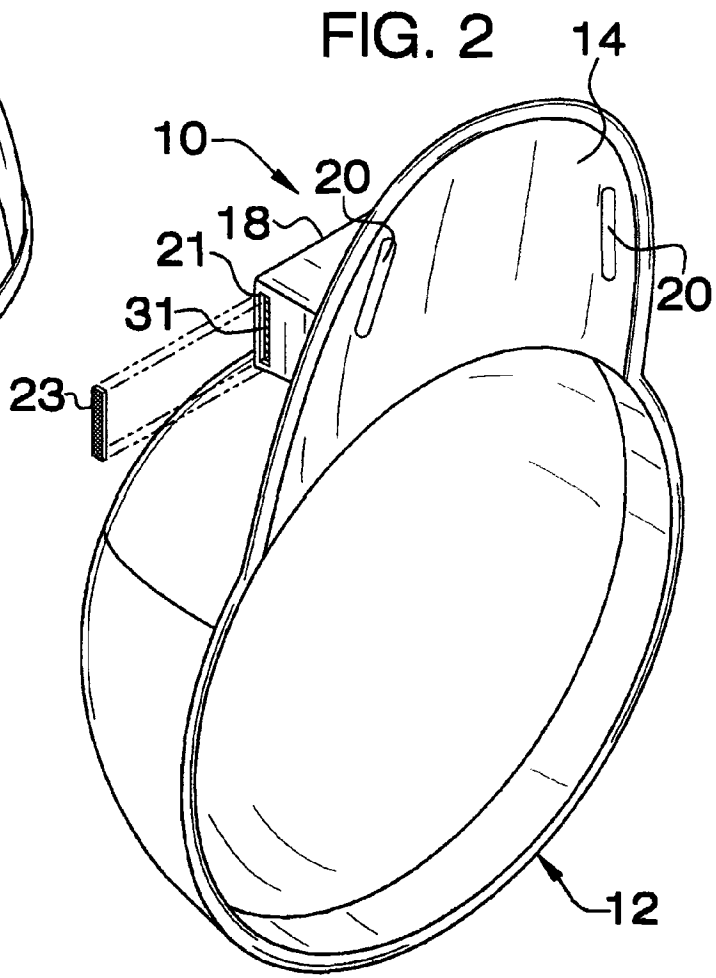
FIG. 2 is a bottom perspective view with an exploded view of a replaceable air filter for clarity.
Figure 1:
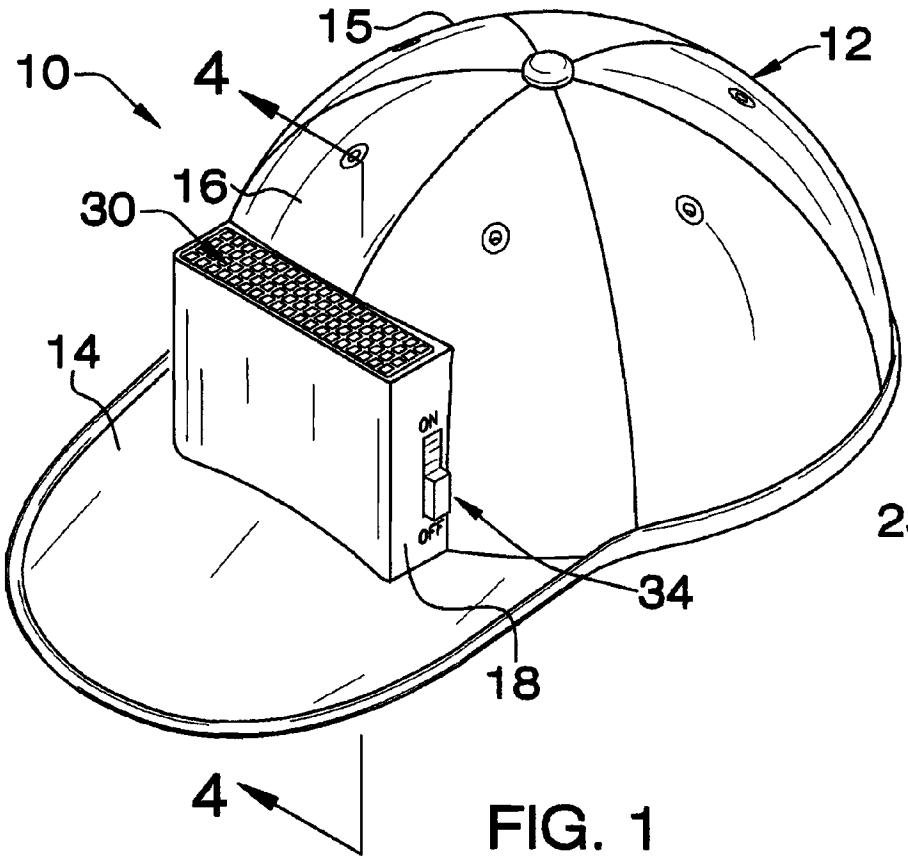
FIG. 1 is a top perspective view, with solar cell.
Figure 3:
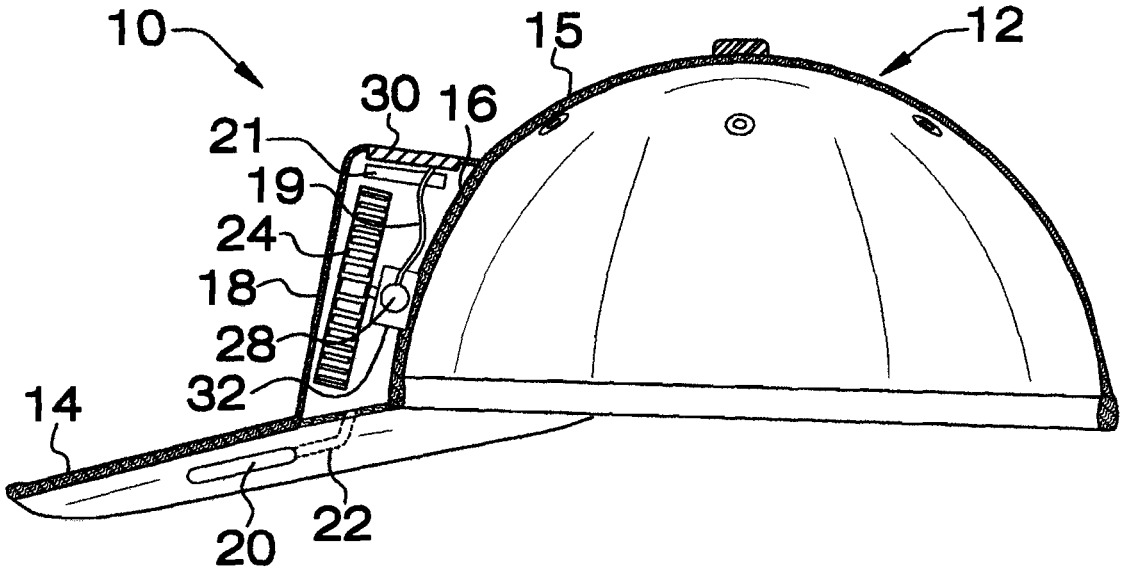
FIG. 3 is a lateral cross sectional view, with optional louver inclusion.

Referring to FIGS. 1, 2, and 3, the ventilated cap apparatus 10 comprises a cap 12 with crown 15 and a bill 14. The parallelepiped housing 18 has a spaced apart front and back 19, a spaced apart top and bottom, and a spaced apart pair of sides. The housing 18 bottom is fitted to the bill 14. The housing 18 back is fitted to the crown front 16. The cage fan 24 is disposed within the housing 18. The cage fan 24 is vertically oriented within the housing 18. The cage fan 24 is so oriented for more than one reason. The cross flow of air through a replaceable air filter 23, into the air intake 21 and out of the channel 22 and exhaust ports 20 is best facilitated by the vertical fan orientation. The vertical fan orientation provides for the narrow, less obtrusive profile of the housing 18 to fit on the back of the bill 14 and against the cap 12 front crown 16. The slim profile of the vertical housing 18 along with the vertical housing 18 front provide for advertising and team logos and the like (not shown). The fan motor 32 is affixed to the back of the housing 18. The fan motor 32 drives the fan 24.

Referring again to FIG. 1, the apparatus 10 is optionally equipped with the porous solar cell 30 in one embodiment. The solar cell 30 equipped embodiment of the apparatus 10 disposes the solar cell 30 in the top of the housing 18. The rechargeable battery 28 is disposed on one side of the motor 32. A replaceable air filter 23 is accessible from said air intake 21 having louvers 31, said air intake located on an upper side of the housing 18, as shown in FIG. 2. The porosity of the solar cell 30 provides for airflow to the air intake 21. The cage fan 24 draws air through the replaceable air filter 23 and intake air intake 21. The motor 32 switch 34 is disposed on the side of the housing 18 opposite the air intake 21 accessibility. The pair of spaced apart exhaust ports 20 is disposed in the underside of the bill 14. The air transfer channel 22 is disposed through the bill 14. The transfer channel 22 is in communication with the housing 18 and the exhaust ports 20.

An alternative embodiment of the apparatus 10, as illustrated in FIG. 3, provides only a battery 28 for motor 32 operation. The louvers 31 are finger-adjustable for direction. The air intake 21 is disposed below the louvers 31. The air intake 21 is accessible from one side of the housing 18.

Various embodiments provide different types of a cap front crown 16. One front crown 16 embodiment comprises a substantially vertical (not shown) front cap crown 16. This embodiment further comprises a substantially vertical (not shown) housing back 19 for fit to the vertical front crown 16. The illustrated embodiment of the apparatus 10 comprises a rounded front crown 16 and a rounded housing back 19. The rounded housing back 19 thereby closely fits to the rounded front crown 16.

The cap 12 crowns 15 also vary in differing embodiments of the apparatus 10. The crown 15 is provided in both rigid and flexible embodiments. Further embodiment variations are provided with an open weave crown 15 for better user head air contact. Additionally, closed weave or densely constructed crowns 15 are also provided.

Figure 4:
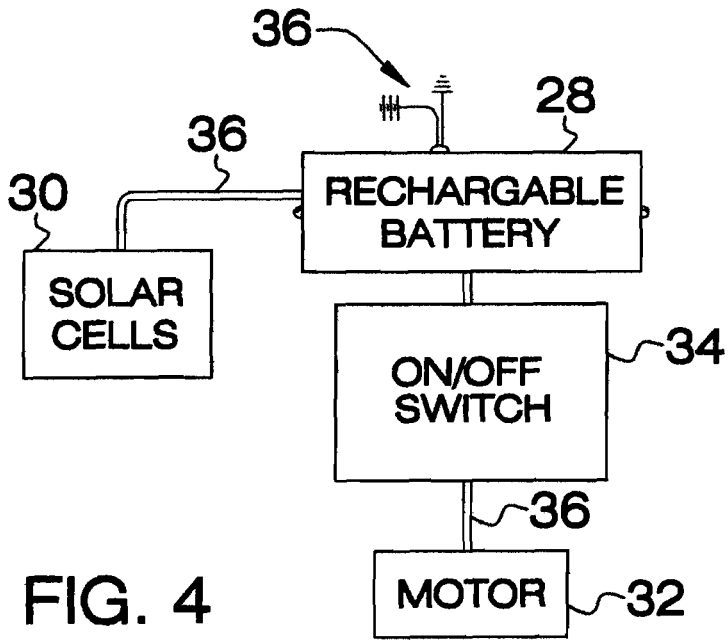
FIG. 4 is schematic block diagram of the electrical components.

Referring to FIG. 4, the electrical components of the housing 18 are in communication via wiring 36. The rechargeable battery 28 is in communication with the solar cell 30. The battery 28 is in communication with the motor 32 via the switch 34.

With respect to the above description then, it is to be realized that the optimum dimensional relationships for the parts of the ventilated cap apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the ventilated cap apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the ventilated cap apparatus may be used.

Therefore, the foregoing is considered as illustrative only of the principles of the ventilated cap apparatus. Further, since numerous modifications and changes will readily occur to those skilled in the art, it is not desired to limit the ventilated cap apparatus to the exact construction and operation shown and described, and accordingly, all suitable modifications and equivalents may be resorted to, falling within the scope of the ventilated cap apparatus.

What is claimed is:

1. A ventilated cap apparatus, the apparatus consisting of:

a cap, the cap having a crown and a bill;

a parallelepiped housing, the housing having a spaced apart front and back, a spaced apart top and bottom, and a pair of spaced apart sides, the housing bottom and back fitted to the bill and a front of the crown, respectively;

a cage fan disposed within the housing, the cage fan vertically oriented within the housing;

a fan motor affixed to the back of the housing, the fan motor driving the fan;

a rechargeable battery disposed on a side of the motor, the battery in communication with the motor;

an air intake disposed on the housing;

a motor switch disposed on one side of the housing;

a pair of spaced apart exhaust ports disposed in an underside of the bill;

a transfer channel disposed through the bill, the transfer channel in communication with the housing and the exhaust ports.

2. The apparatus in claim 1 wherein the air intake is further comprised of adjustable angle louvers.

3. The apparatus in claim 2 further comprising a substantially vertical housing back for fit to a substantially vertical front cap crown.

4. The apparatus in claim 2 further comprising a rounded front crown and a rounded housing back.

5. The apparatus in claim 1 wherein a filter is disposed adjacent to the air intake.

6. The apparatus in claim 5 wherein the filter is replaceable.

7. The apparatus in claim 6 further comprising a substantially vertical housing back for fit to a substantially vertical front cap crown.

8. The apparatus in claim 5 further comprising a substantially vertical housing back for fit to a substantially vertical front cap crown.

9. The apparatus in claim 5 further comprising a rounded front crown and a rounded housing back.

10. The apparatus in claim 6 further comprising a rounded front crown and a rounded housing back.

11. The apparatus in claim 1 further comprising a substantially vertical housing back for fit to a substantially vertical front cap crown.

12. The apparatus in claim 1 further comprising a rounded front crown and a rounded housing back.

13. A ventilated cap apparatus, the apparatus consisting of:

a cap, the cap having a crown and a bill;

a parallelepiped housing, the housing having a spaced apart front and back, a spaced apart top and bottom, and a pair of spaced apart sides, the housing bottom and back fitted to the bill and a front of the crown, respectively;

a cage fan disposed within the housing, the cage fan vertically oriented within the housing;

a fan motor affixed to a back of the housing, the fan motor driving the fan;

a porous solar cell disposed in the top of the housing;

a rechargeable battery disposed on a side of the motor, the battery in communication with the solar cell and with the motor;

an air intake disposed under the solar cell;

a motor switch disposed on one side of the housing;

a pair of spaced apart exhaust ports disposed in an underside of the bill;

a transfer channel disposed through the bill, the transfer channel in communication with the housing and the exhaust ports.

14. The apparatus in claim 13 wherein a filter is disposed adjacent to the solar cell.

15. The apparatus in claim 14 wherein the filter is replaceable.

16. The apparatus in claim 15 further comprising a substantially vertical housing back for fit to a substantially vertical front cap crown.

17. The apparatus in claim 14 further comprising a substantially vertical housing back for fit to a substantially vertical front cap crown.

18. The apparatus in claim 14 further comprising a founded housing back for fit to a rounded front cap crown.

19. The apparatus in claim 15 further comprising a rounded housing back for fit to a rounded front cap crown.

* * * * *